US009381418B2

(12) United States Patent
Sullivan

(10) Patent No.: US 9,381,418 B2
(45) Date of Patent: Jul. 5, 2016

(54) PORTABLE CLAMP FOR HOCKEY EQUIPMENT

(71) Applicant: Christopher Sullivan, Apple Valley, MN (US)

(72) Inventor: Christopher Sullivan, Apple Valley, MN (US)

( * ) Notice: Subject to any disclaimer, the term of this patent is extended or adjusted under 35 U.S.C. 154(b) by 0 days.

(21) Appl. No.: 14/137,579

(22) Filed: Dec. 20, 2013

(65) Prior Publication Data

US 2014/0175245 A1 Jun. 26, 2014

Related U.S. Application Data

(60) Provisional application No. 61/740,326, filed on Dec. 20, 2012.

(51) Int. Cl.
*A63B 71/00* (2006.01)

(52) U.S. Cl.
CPC ..... *A63B 71/0036* (2013.01); *A63B 71/0045* (2013.01); *A63B 2102/24* (2015.10)

(58) Field of Classification Search
USPC ..... 248/309.1, 311.2, 312, 316.1, 316.7, 248/682, 689, 214; 211/60.1, 62, 64, 65, 211/68, 69.1, 70.2, 70.5, 70.6, 70.8; 206/315.1
See application file for complete search history.

(56) References Cited

U.S. PATENT DOCUMENTS

| | | | | | |
|---|---|---|---|---|---|
| 1,342,136 | A * | 6/1920 | Smith | 248/229.1 |
| 1,570,500 | A * | 1/1926 | Kennedy | 206/315.6 |
| 2,265,330 | A * | 12/1941 | Waddle et al. | 248/538 |
| 2,448,752 | A * | 9/1948 | Wagner | 248/512 |
| 2,590,154 | A * | 3/1952 | Burns | 280/47.19 |
| 4,467,925 | A * | 8/1984 | Ratzloff et al. | 211/70.6 |
| 4,641,755 | A * | 2/1987 | Oliver et al. | 211/60.1 |
| 4,854,456 | A * | 8/1989 | Lee | 211/14 |
| 4,936,467 | A * | 6/1990 | Bobeczko | 211/14 |
| 5,582,290 | A * | 12/1996 | McCuaig et al. | 206/315.6 |
| 7,392,901 | B2 * | 7/2008 | Cameron et al. | 206/315.11 |

* cited by examiner

*Primary Examiner* — Alfred J Wujciak
(74) *Attorney, Agent, or Firm* — Schwegman Lundberg & Woessner, P.A.

(57) ABSTRACT

A clamp assembly configured for holding hockey sticks and hockey puck comprises an adjustable bracket having a generally square-shaped cross-section, the bracket being configured to hold shafts of four hockey sticks, and at least one puck clamp coupled to the adjustable bracket, the at least one puck clamp being configured to secure a hockey puck proximate to the adjustable bracket.

11 Claims, 2 Drawing Sheets

PORTABLE CLAMP FOR HOCKEY EQUIPMENT

CROSS-REFERENCE TO RELATED APPLICATION

This application claims the benefit of priority of U.S. Provisional Patent Application Ser. No. 61/740,326, filed on Dec. 20, 2012, which application is incorporated by reference herein in its entirety.

TECHNICAL FIELD

This disclosure relates to the field of sports equipment and apparent organization and display. The portable device can hold hockey sticks and hockey pucks that can create a hook and a rack system to organize hockey apparel and gear.

BACKGROUND

Holding and storing hockey gear and equipment is very limited. There are few if any devices for holding hockey apparel and gear for display, or for organizing or drying out the apparel and equipment. Most such devices and systems are large rack systems consisting of multiple poles that are not convenient or portable.

SUMMARY

The present disclosure describes a clamp configured for holding hockey sticks and hockey pucks, the clamp comprising an adjustable bracket having a generally square-shaped cross-section, the bracket being configured to hold shafts of four hockey sticks, and at least one puck clamp coupled to the adjustable bracket, the at least one puck clamp being configured to secure a hockey puck proximate to the adjustable bracket.

DETAILED DESCRIPTION

The following description and the drawings sufficiently illustrate specific embodiments to enable those skilled in the art to practice them. Portions and features of some embodiments may be included in, or substituted for, those of other embodiments. Embodiments set forth in the claims encompass all available equivalents of those claims.

Figure 1:
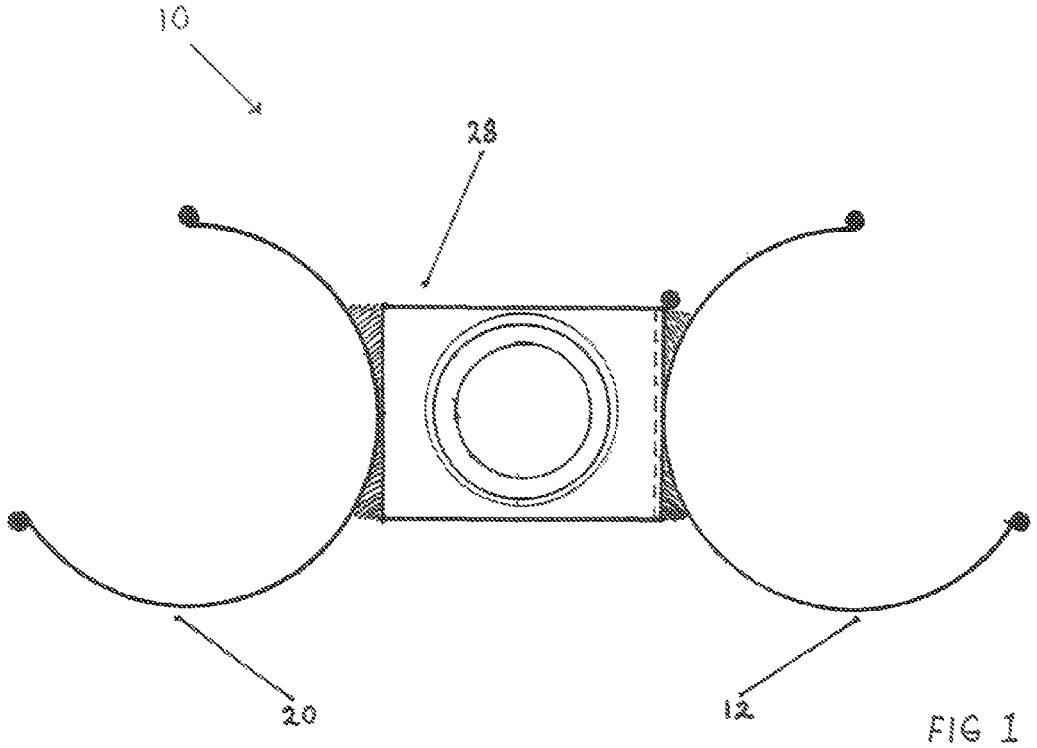
FIG. 1 is a front view of an example adjustable clamp in accordance with the present disclosure.
Figure 2:
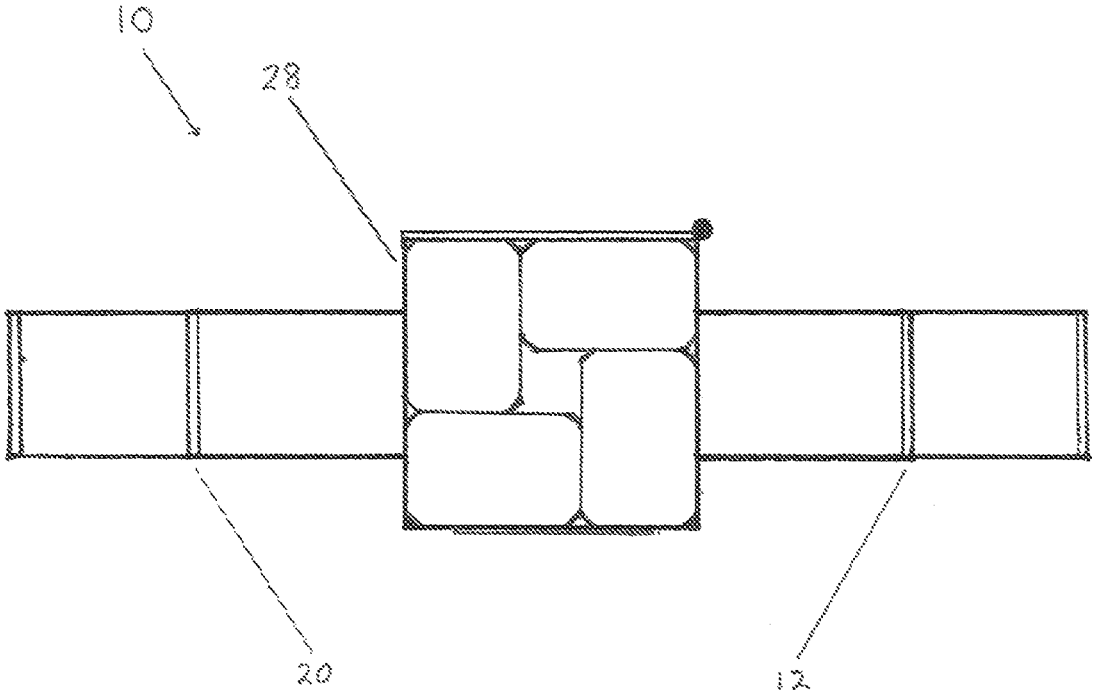
FIG. 2 is a top view of the example adjustable clamp shown in FIG. 1.

FIGS. 1 and 2 show an example of a clamp assembly 10 configured for holding hockey sticks and hockey pucks. The clamp 10 can include an adjustable bracket 28 having a generally square-shaped cross-section. The bracket 28 can be configured to hold shafts of four hockey sticks. The bracket 28 can be used to hold the shafts of the hockey sticks in a generally upright manner so that the sticks can form a "coat tree," e.g., so that the blades of the hockey sticks form a base to support and keep the sticks in a vertical, upright configuration. In an example, the blades of each of the four sticks can be oriented in one of four directions to form the base. The coat tree can accommodate hockey apparel. For example, a hockey helmet can be placed on top of the sticks. FIG. 2 shows a top view of the clamp with the shafts of the hockey sticks arranged in a generally rectangular pattern.

The clamp assembly 10 also comprises at least one puck clamp 12, 20 coupled to the adjustable bracket 28. Each of the puck clamps 12, 20 can be configured to secure a hockey puck proximate to the adjustable bracket 28. In an example, the puck clamps 12, 20 can be oriented so that when a hockey puck (not shown) is secured in the puck clamp 12, 20, the puck will be oriented in a substantially vertical orientation (e.g., when the hockey sticks are secured by the adjustable bracket 28 to form the coat tree). Vertical orientation of the puck can provide for displaying of a logo on the puck, such as a team logo or some other indicia. As shown in FIGS. 1 and 2, the at least one puck clamp comprises a first puck clamp 12 coupled to a first side of the adjustable bracket 28 and a second puck clamp 20 coupled to a second side of the adjustable bracket 28.

In an example, the adjustable bracket 28 can comprise a hollow rectilinear cylinder having a bore extending therethrough for receiving the shafts of the hockey sticks. The rectilinear cylinder of the adjustable bracket 28 can have a height in a first direction (e.g., a vertical or up and down direction in FIG. 1), a width in a second direction that is perpendicular to the first direction (e.g., the second direction can be a first horizontal direction, e.g., depicted as left to right in FIGS. 1 and 2), and a thickness in a third direction that is perpendicular to the first direction and the second direction (e.g., the third direction can be a second horizontal direction, e.g., depicted as up and down in FIG. 2). When hockey sticks are clamped inside the adjustable bracket 28, the hockey sticks will be oriented in the first direction (e.g., up and down in FIG. 1). Similarly, when the hockey sticks are clamped in the adjustable bracket 28 and hockey pucks are in the hockey clamps 12, 20, the pucks will be oriented in the first directional, e.g., so that the hockey pucks are substantially parallel to a plane that is in the first direction and the second direction.

In an example, the bore within the rectilinear cylinder of the adjustable bracket 28 has a generally square-shaped cross section. The bore can have a width in one direction (e.g., the second direction, left to right in FIG. 2) that is about 2 inches, and can have a length in a second direction (e.g., the third direction, up and down in FIG. 2) that is about 2 inches. The generally square shape of the bore can allow up to four hockey sticks to be inserted together into the adjustable bracket 28 to bind the sticks together in a generally vertical orientation. In an example, the hollow rectilinear cylinder can comprise a sheet of resilient material shaped into the hollow rectilinear cylinder. The sheet of resilient material can comprise a first fastener at a first end of the sheet and a second fastener at a second end of the sheet, wherein the first fastener and the second fastener cooperate together to releasably secure the sheet into the hollow rectilinear cylinder. In an example, the first fastener can comprise a first side of a Velcro-type fastener and the second fastener can comprise the mating side of the Velcro-type fastener. Other fastener types can include a snap, clip, latch, buckle, and the like. The releasable fastener can allow the cylinder to be opened up to allow for loading and positioning of the shafts of the hockey sticks in the adjustable bracket 28. The adjustable bracket 28 can then be closed so that the resilient material clamps around the sticks to secure them in place.

In an example, each of the one or more puck clamps 12, 20 comprises a strip of resilient material having a generally c-shaped cross section, best seen in FIG. 1. In an example, the c-shape can be a portion of a circle having an inner diameter that is substantially the same as a hockey puck diameter. The actual value of the inner diameter of the c-shaped puck clamp 12, 20 can depend on the type of material used, e.g., the resiliency of the material, and the amount of force desired to secure a hockey puck in the puck clamp 12, 20. In an example, a diameter of each puck clamp 12, 20 is about 3 inches.

As further shown in FIG. 1, each c-clamp of the example puck clamps 12, 20 can extend further on the bottom of the c-clamp than on the top of the c-clamp to provide greater support on a bottom side of the puck. In an example, each puck clamp 12, 20 can also comprise a lip at each end of the c-clamp having a thickness that is slightly greater than a thickness of the rest of the puck clamp 12, 20 (best seen in FIG. 1).

In an example, the adjustable bracket 28 can also be configured so that it can receive and hold one or more hockey pucks, e.g., so that the hockey sticks can be removed from the adjustable bracket 28 and the clamp assembly 10 can be used as a puck carrier, with one or more pucks being carried in each puck clamp 12, 20, and one or more pucks also being carried in the adjustable bracket. In an example, the adjustable bracket 28 can comprise on or more portions that comprise a resilient material with sufficient give to accommodate the hockey puck.

In an example, the adjustable bracket 28 can comprise a metal or rigid plastic base material. The puck clamps 12, 20 can also comprise the same metal or rigid base material or a different base material. In example, the adjustable bracket 28 and the puck clamps 12, 20 can comprise a base metal such as aluminum. The base material of one or both of the adjustable bracket 28 and the puck clamps 12, 20 can be coated with a coating material that can provide surface properties to one or more of the adjustable bracket 28 and/or the puck clamps 12, 20. In an example, the coating can comprise a rubberized material that can provide for easier gripping of the clamp assembly 10 by a user. The rubberized material can be configured to simulate the look and feel of a hockey puck so that at least a portion of the clamp assembly 10 can mimic a hockey puck.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A clamp assembly configured for holding hockey sticks and hockey pucks, the clamp comprising:

an adjustable bracket having a height in a vertical direction, a width in a first horizontal direction that is perpendicular to the vertical direction, and a thickness in a second horizontal direction that is perpendicular to the vertical direction and the first horizontal direction, the adjustable bracket defining a bore extending in the vertical direction, the bore being configured to receive and hold shafts of four hockey sticks so that the shafts of the four hockey sticks are bound together and oriented generally in the vertical direction to stand the clamp assembly and so that blades of each of the four hockey sticks are oriented in one of four horizontal directions to form a base of support that keeps the four hockey sticks and the clamp assembly in a generally vertical configuration; and at least one puck clamp coupled to the adjustable bracket, the at least one puck clamp comprising a strip of resilient material having a generally c-shaped cross section, wherein an inner diameter of the generally c-shaped puck clamp that is substantially the same as a hockey puck diameter, the at least one puck clamp being configured to secure a hockey puck proximate to the adjustable bracket.

2. The clamp assembly of claim 1, wherein the at least one puck clamp is oriented in a plane that is substantially in the vertical direction and the first horizontal direction so that a puck being held in the puck clamp is oriented substantially in the vertical direction.

3. The clamp assembly of claim 2, wherein the puck being held in the puck clamp includes a logo or other indicia on a face of the puck, wherein the puck clamp is oriented so that the logo or other indicia is viewable from a front of the clamp assembly.

4. The clamp assembly of claim 1, wherein the at least one puck clamp comprises a first puck clamp coupled to a first horizontal side of the adjustable bracket and a second puck clamp coupled to a second horizontal side of the adjustable bracket.

5. The clamp assembly of claim 1, wherein the adjustable bracket comprises a hollow rectilinear cylinder and wherein the bore has a generally square-shaped cross section.

6. The clamp assembly of claim 1, wherein the adjustable bracket comprises a sheet of resilient material shaped into the adjustable bracket to form the bore.

7. The clamp assembly of claim 6, wherein a first end of the sheet of resilient material is releasably secured to a second end of the sheet of resilient material to form the bore.

8. The clamp assembly of claim 7, wherein the sheet of resilient material is secured into a hollow rectilinear cylinder so that the bore has a generally square-shaped cross section.

9. The claim assembly of claim 6, wherein the sheet of resilient material is shaped into a hollow rectilinear cylinder.

10. The clamp assembly of claim 1, wherein the inner diameter of the at least one puck clamp is about 3 inches.

11. The clamp assembly of claim 1, wherein the adjustable bracket is configured to hold one or more hockey pucks in the bore.

* * * * *